US005207858A

United States Patent [19]

DeBarber et al.

[11] Patent Number: 5,207,858

[45] Date of Patent: May 4, 1993

[54] EJECTION APPARATUS FOR MODULAR ENVELOPE INSERTER

[75] Inventors: Christopher DeBarber, Woodbury; Sandra Graveson, Waterbury; Joseph H. Marzullo, Brookfield, all of Conn.

[73] Assignee: Pitney Bowes Inc., Stamford, Conn.

[21] Appl. No.: 937,268

[22] Filed: Aug. 31, 1992

[51] Int. Cl.[5] ..... B65H 9/06; B05C 1/00

[52] U.S. Cl. ..... 156/441.5; 156/442.2; 271/2; 271/185; 271/302

[58] Field of Search ..... 118/264, 268, 429; 156/441.5, 442.1, 442.2, 442.3; 271/2, 280, 302, 185; 53/383.1

[56] References Cited

U.S. PATENT DOCUMENTS 4,450,037 5/1984 Gavronsky ..... 156/442.2
4,911,422 3/1990 Auerbach ..... 271/225
4,928,807 5/1990 Auerbach ..... 271/185
5,088,442 2/1992 Joson et al. ..... 156/442.2
5,131,643 7/1992 Graveson et al. ..... 271/2
5154,405 10/1992 Graveson et al. ..... 271/225

*Primary Examiner*—David A. Simmons
*Assistant Examiner*—William J. Matney, Jr.
*Attorney, Agent, or Firm*—Charles R. Malandra, Jr.; Melvin J. Scolnick

[57] ABSTRACT

Apparatus for removing an envelope from a stream of envelopes moving along a straight path. The apparatus includes: an envelope turner; a device for raising and lowering the downstream end of the envelope turner; an envelope sealer situated adjacent and downstream of the envelope turner; a device for detecting an envelope to be ejected; and a device for signaling the raising and lowering device to be raised in order to feed an envelope to be ejected over the envelope sealer.

5 Claims, 4 Drawing Sheets

EJECTION APPARATUS FOR MODULAR ENVELOPE INSERTER

BACKGROUND OF THE INVENTION

The instant invention relates generally to envelope inserting apparatus, and more particularly to an ejection device for mis-inserted envelopes associated with an envelope turner and an envelope sealer.

Machines for inserting documents and the like into envelopes are well known. These inserting machines are typically associated with an in-line mailing machine located downstream which prints the requisite postage on the stuffed envelope. However, prior to the postage being printed, it is usually necessary to turn the envelope 90 degrees or 180 degrees depending on the configuration of the metering equipment in relation to the inserting equipment. If the postage meter is oriented in the same direction as the discharge from the inserting equipment, a turn of 90 degrees is required for the envelope; if the postage meter is oriented 90 degrees to the direction of the inserting equipment, a turn of 180 degrees is required by the envelope.

It sometimes happens that an envelope that is intended to be stuffed does not get opened and thus contains no inserts. It is also a fact that in the course of the inserting process, some envelopes become damaged. It then becomes necessary to remove these unopened or damaged envelopes from the flow of envelopes so that they do not reach the postage meter and further processing.

Many prior art devices are known for removing mis-inserted envelopes from the paper path of an inserting system. One such ejection system removes the mis-inserted envelope between the envelope inserter and an envelope turning device, and is disclosed in U.S. Pat. No. 4,911,422 issued Mar. 27, 1990 to the assignee of the instant invention. The prior art ejection systems typically consume additional length in the path of travel of the envelope, which is undesirable in many applications because space is usually limited. Also, the prior art ejection systems are complex and thus are more prone to breakdown.

Accordingly, the instant invention provides an envelope ejection device in association with an envelope turner which does not lengthen the path of travel of the envelopes, and which is considerably less complex in terms of number of parts and manner of operation.

SUMMARY OF THE INVENTION

The instant invention provides apparatus for removing an envelope from a stream of envelopes moving along a straight path. The apparatus includes: an envelope turner; means for raising and lowering the downstream end of the envelope turner; an envelope sealer situated adjacent and downstream of the envelope turner; means for detecting an envelope to be ejected; and means for signaling the raising and lowering means to be raised in order to feed an envelope to be ejected over said envelope sealer.

DETAILED DESCRIPTION OF THE PREFERRED EMBODIMENT

Figure 1:
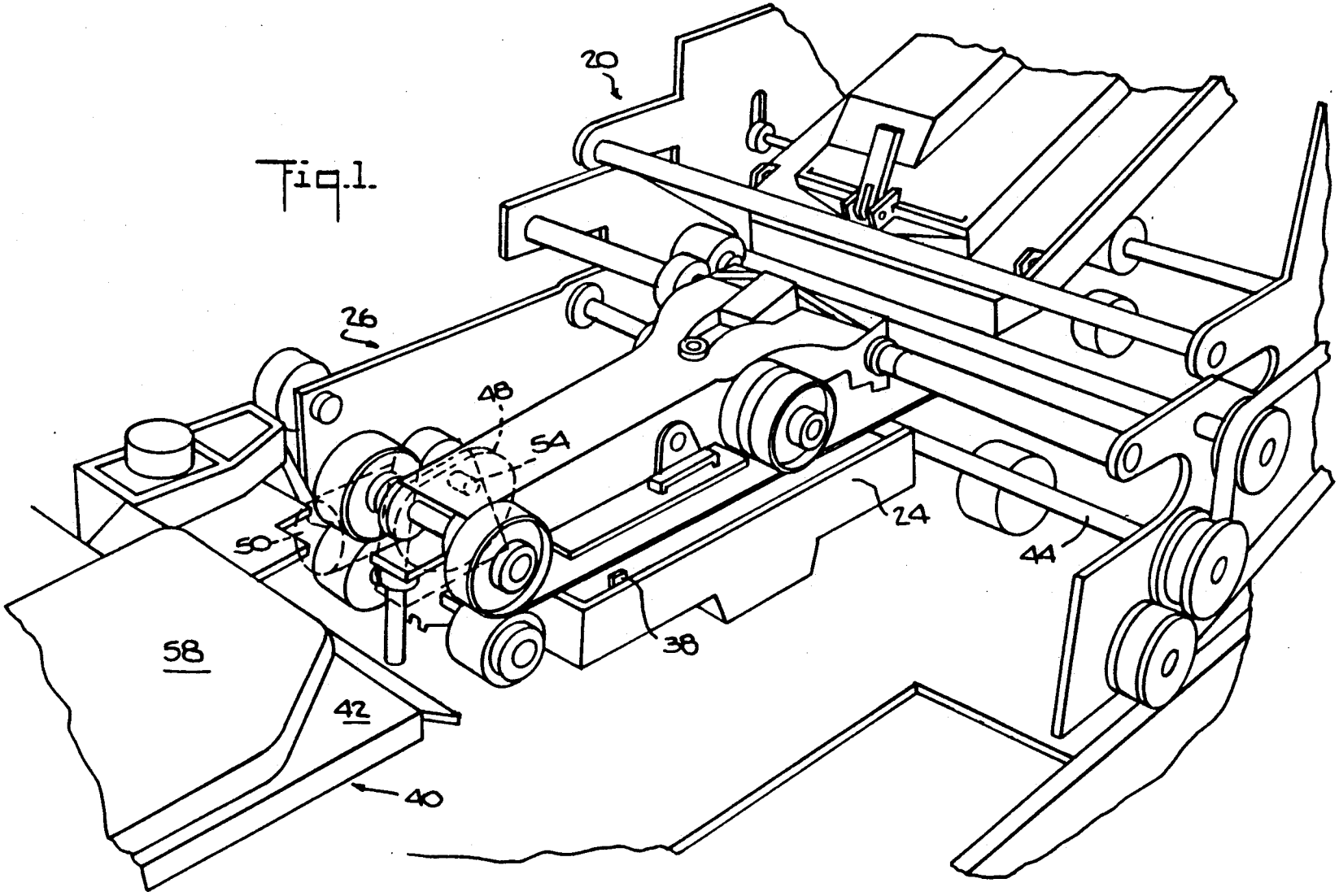
FIG. 1 is a perspective view of an envelope turning apparatus having an envelope ejection device in accordance with the instant invention.
Figure 2:
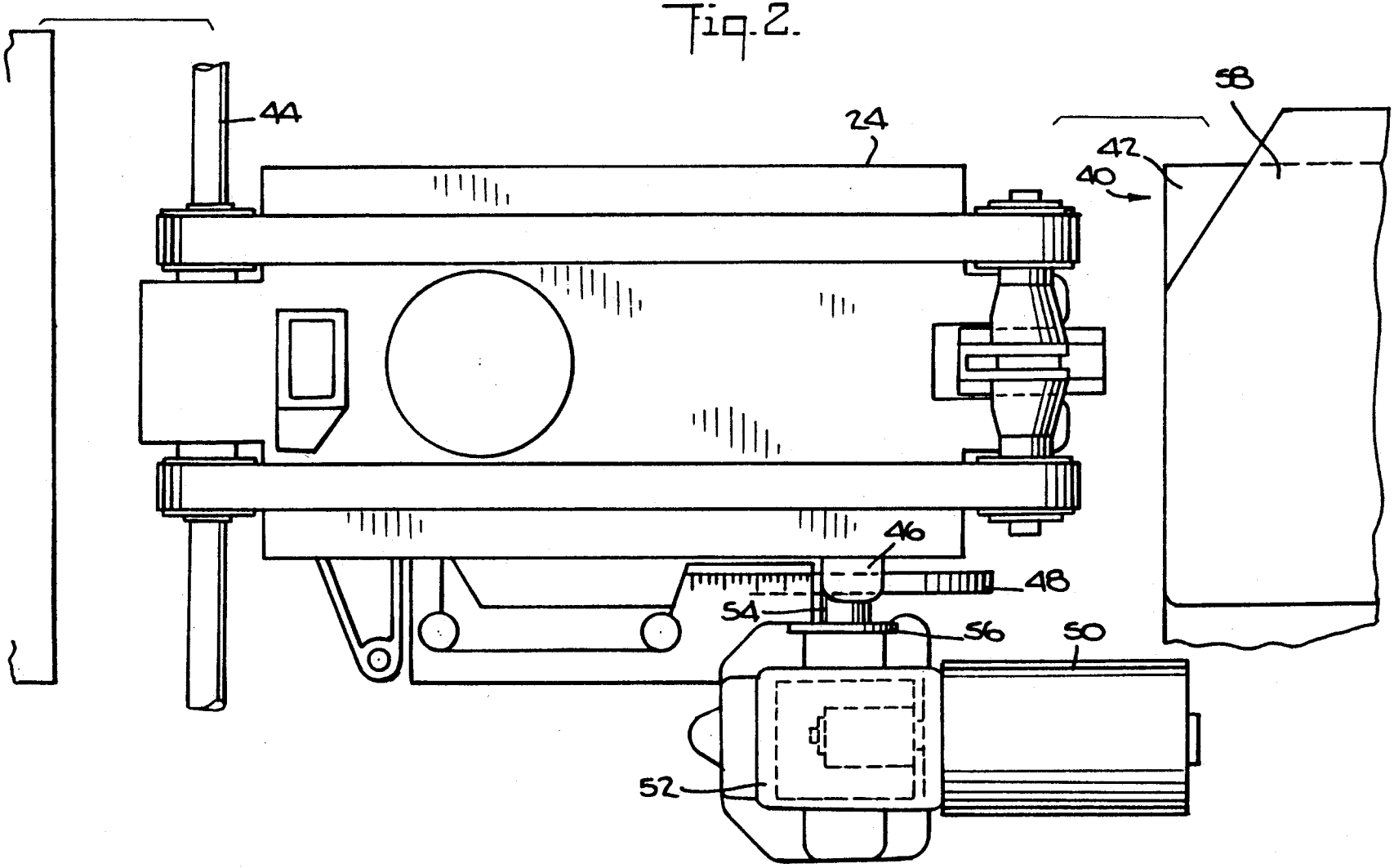
FIG. 2 is a top, plan view of the apparatus seen in FIG. 1.
Figure 3:
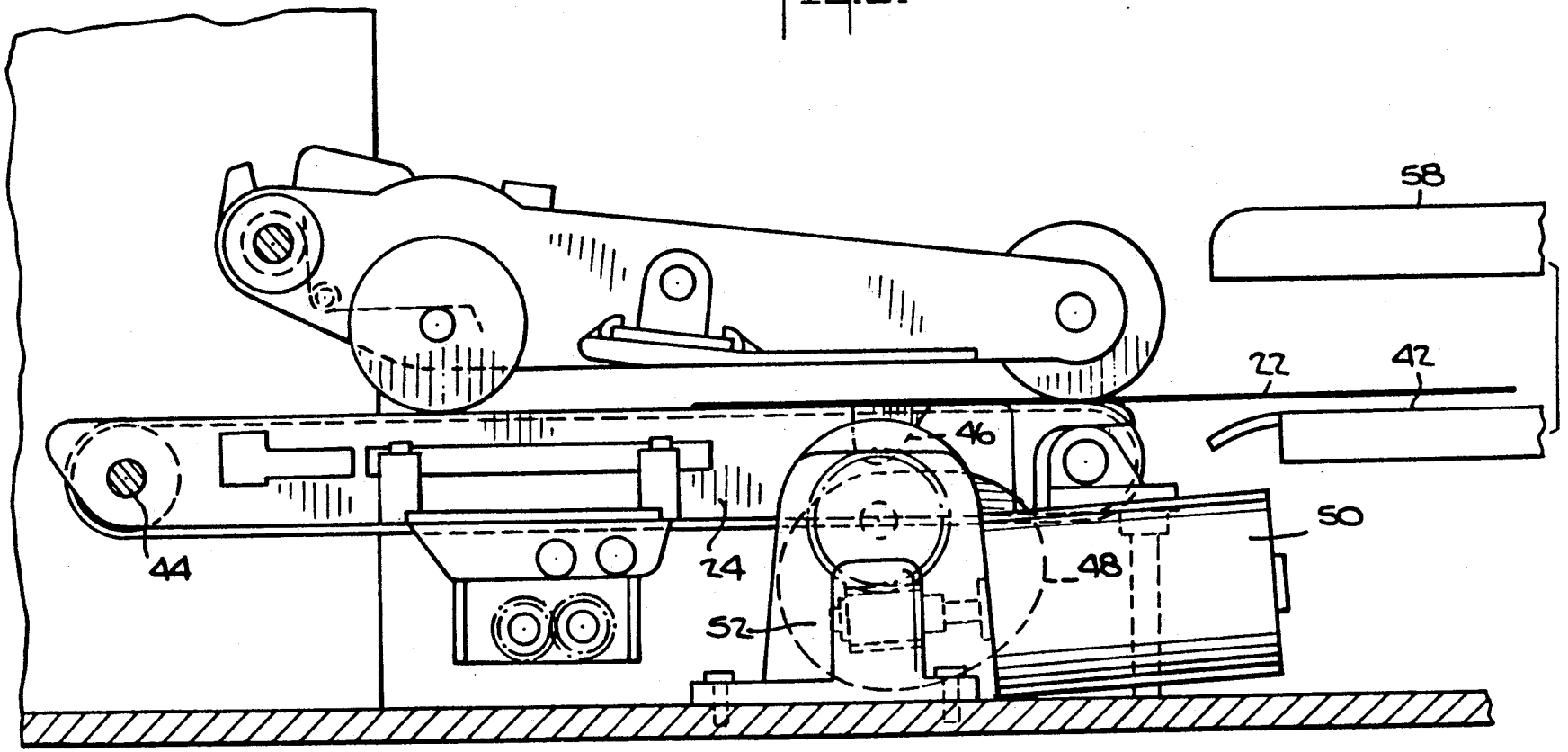
FIG. 3 is a side, elevational view of the apparatus seen in FIG. 1.
Figure 4:
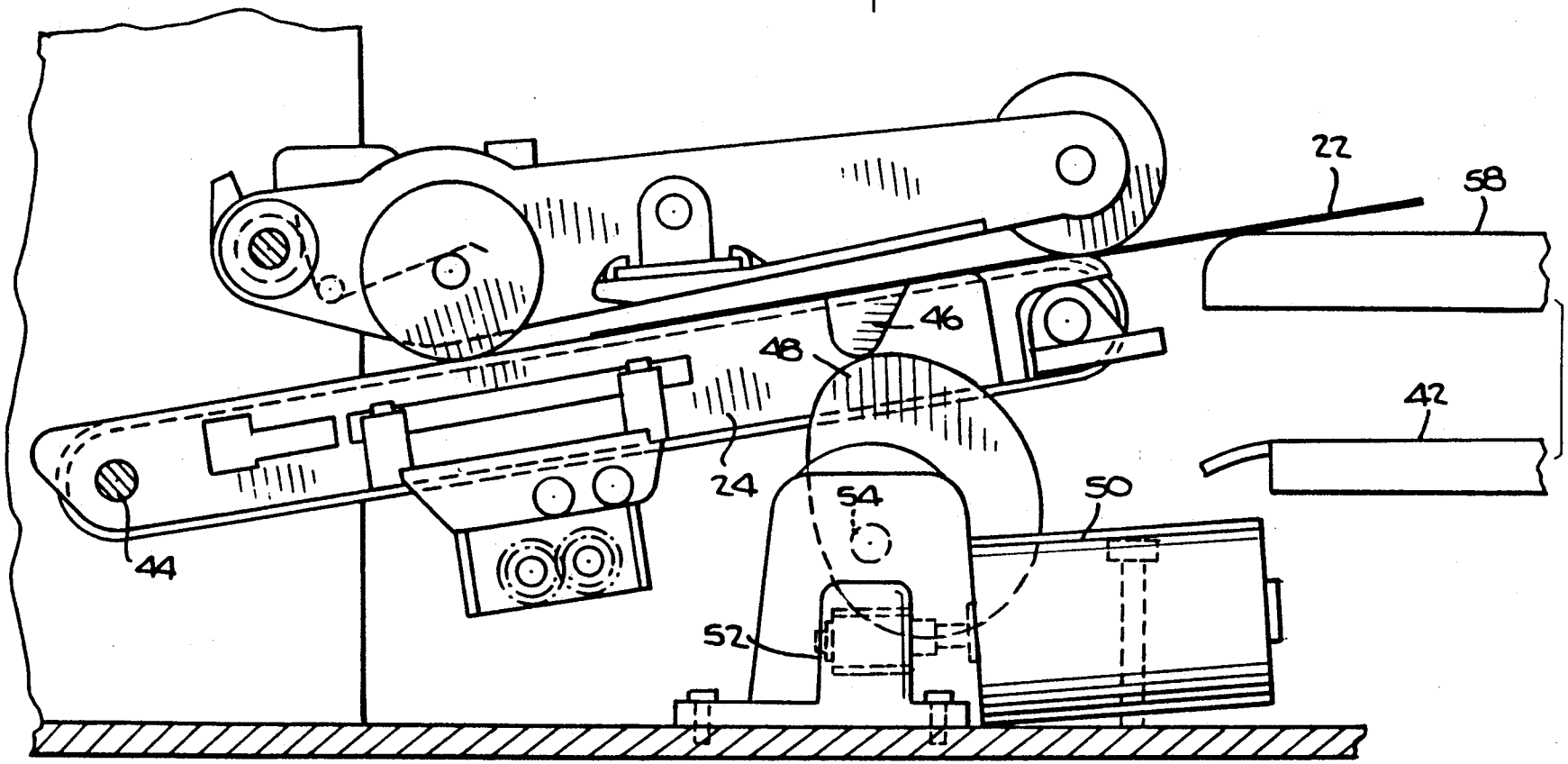
FIG. 4 is similar to FIG. 3 but shows the turner in the ejection mode.

In describing the preferred embodiment of the instant invention, reference is made to the drawings, wherein there is seen in FIG. 1 a table-top inserter generally designated 20 which feeds and inserts documents (not seen) into an envelope 22. The stuffed envelope 22 is then fed onto a feed deck 24 of an envelope turning apparatus generally designated 26.

When an envelope 22 has been filled with inserted documents by the inserter 20 and sensors verify that the proper documents have been inserted, a pair of registration stop fingers 38 are raised and the envelope 22 is released by the inserter 20. The envelope 22 is fed to a position where it is stopped and aligned by the registration stops 38. Once the envelope 22 is resting against the stops 38, it is ready to be turned 90 degrees, which is effected by a spindle/geneva (not shown) located under the deck 24 which is raised and rotated 90 degrees. The 90 degree rotation turns the envelope 22 to align with a sealing device 40 downstream. Before the 90 degree rotation is effected, the stops 38 are retracted.

Properly filled envelopes 22 are then fed to the deck 42 of the sealing device 40 in order for the envelope flap to be moistened and sealed. It does happen occasionally that an envelope does not get stuffed because it was not properly opened, or an envelope becomes damaged. In these cases, there are sensors that recognize these situations and cause the unopened or damaged envelopes to be ejected from the flow of envelopes so that they do not enter the sealing device 40.

The envelope turner 26 is pivotably mounted at its upstream end on a shaft 44. The downstream end of the turner feed deck 24 includes a cam profile 46 which engages a cam 48. A motor 50 is connected to a gear box 52 which drives a shaft 54 which in turn drives the cam 48. A disk 56 having an encoder is mounted on the shaft 54 to ensure that the cam 48 is always stopped in the right position.

In operation, whenever an unopened or damaged envelope is sensed, a signal is sent to the motor 50 which, through the gear box 52, turns the shaft 54 and rotates the cam 48 against the cam profile 46 so that the turner feed deck 24 is raised. The unopened or damaged envelope 22, instead of being fed onto the deck 42 of the sealing device 40 is fed onto the top surface 58 of the sealing device 40 where it can be manually collected.

The continued rotation of the cam 48 returns the feed deck 24 to its normal level so that envelopes 22 can be fed to the deck 42 of the sealing device 40. Because no additional apparatus is required to eject the envelopes 22, the length required to house the inserter 20 is not increased.

While the invention has been described in conjunction with specific embodiments thereof, many alternatives, modifications and variations will be apparent to those skilled in the art. The invention is intended to embrace all such alternatives, modifications and variations that follow within the spirit and scope of the appended claims.

What is claimed is:

1. Apparatus for removing an envelope from a stream of envelopes moving along a straight path, comprising:

an envelope turner;

means for raising and lowering the downstream end of said envelope turner;

an envelope sealer situated adjacent and downstream of said envelope turner;

means for detecting an envelope to be ejected; and means for signaling said raising and lowering means to be raised in order to feed an envelope to be ejected over said envelope sealer.

2. The apparatus of claim 1, wherein said raising and lowering means comprises a cam profile secured to the downstream end of said envelope turner and a cam for engaging said cam profile.

3. The apparatus of claim 2, wherein said envelope sealer includes a deck for receiving an ejected envelope.

4. The apparatus of claim 3, additionally comprising an encoder operatively connected to said cam to ensure that said cam is stopped in a proper position.

5. The apparatus of claim 4, wherein said envelope turner is pivotably mounted at its upstream end.

* * * * *